US007087000B1

(12) United States Patent
Walker

(10) Patent No.: US 7,087,000 B1
(45) Date of Patent: Aug. 8, 2006

(54) COLLARLESS BARBELL SLEEVE

(76) Inventor: Morris Wayne Walker, 23510 Clark Dr., Philomath, OR (US) 97370

( * ) Notice: Subject to any disclaimer, the term of this patent is extended or adjusted under 35 U.S.C. 154(b) by 250 days.

(21) Appl. No.: 10/803,372

(22) Filed: Mar. 19, 2004

Related U.S. Application Data

(60) Provisional application No. 60/514,578, filed on Oct. 27, 2003.

(51) Int. Cl.
*A63B 21/072* (2006.01)

(52) U.S. Cl. ..... 482/107; 482/106

(58) Field of Classification Search ..... 482/106–109; 446/241; 403/328, 366
See application file for complete search history.

(56) References Cited

U.S. PATENT DOCUMENTS

| | | | | |
|---|---|---|---|---|
| 808,706 | A | 1/1906 | Villedrouin | |
| 3,679,244 | A | 7/1972 | Reddy | |
| 4,529,197 | A | 7/1985 | Gogarty | |
| 4,529,198 | A | 7/1985 | Hettick, Jr. | |
| 4,579,337 | A | 4/1986 | Uyeda | |
| 4,638,994 | A | 1/1987 | Gogarty | |
| 4,738,446 | A | 4/1988 | Miles | |
| 4,787,629 | A * | 11/1988 | DeMyer | 482/107 |
| 4,822,034 | A | 4/1989 | Shields | |
| 4,955,603 | A * | 9/1990 | Becker | 482/107 |
| 5,284,463 | A | 2/1994 | Shields | |
| 5,295,934 | A | 3/1994 | Collins | |
| 5,605,411 | A | 2/1997 | Wilson | |
| 5,839,997 | A | 11/1998 | Roth et al. | |
| 6,228,003 | B1 | 5/2001 | Hald | |
| 6,656,093 | B1 * | 12/2003 | Chen | 482/108 |
| 6,669,606 | B1 | 12/2003 | Krull | |
| 6,682,464 | B1 | 1/2004 | Shifferaw | |
| 6,971,974 | B1 * | 12/2005 | Bowman et al. | 482/107 |
| 2003/0004040 | A1 | 1/2003 | Parker | |
| 2003/0232705 | A1 * | 12/2003 | Harms et al. | 482/108 |
| 2005/0079961 | A1 * | 4/2005 | Dalebout et al. | 482/106 |

* cited by examiner

*Primary Examiner*—Stephen R. Crow
*Assistant Examiner*—Allana Lewin
(74) *Attorney, Agent, or Firm*—Bert P. Krages, II

(57) ABSTRACT

A means of quickly securing and unsecuring plates on the ends of barbells, dumbbells, and similar exercise equipment without the use of separable collars. The plates are secured by means of one or more plungers that are actuated by an internal mechanism that causes the plunger or plungers to rise above the outer circumference of the end of the bar.

13 Claims, 5 Drawing Sheets

COLLARLESS BARBELL SLEEVE

CROSS REFERENCE TO RELATED APPLICATIONS

This application claims the benefit to the prior provisional patent application 60/514,578 filed Oct. 27, 2003, the filing date of which is hereby claimed and which application is hereby adopted by reference as part of the present disclosure.

BACKGROUND OF THE INVENTION

1. Field of the Invention

The invention relates to a means of quickly securing and removing plates on and from the ends of barbells, dumbbells, and similar exercise equipment without the use of separable collars.

2. Prior Art

Exercise and physical activity are important and beneficial for long-term health and well-being. Strength training is an important component of exercise and can be done with calisthenic exercises such as push-ups, free weights such as barbells and dumbbells, or resistance machines.

Free weights are favored by many fitness enthusiasts because they recruit more muscle groups than resistance machines, which tend to only isolate specific muscles. Free weights are also more versatile than machines because they allow for more variations in range of motion, require balance, and tend to promote more activity of the joint stabilizer muscles. Finally, they are considerably less expensive than most of the machines on the market.

The two common forms of free weights are barbells and dumbbells. Barbells are typically designed with one or more weights disposed at each end of a bar and are intended to be lifted with two arms. Dumbbells are similar but have a shorter bar and are intended to be lifted with one arm. These devices are used during the course of various exercises to increase strength by providing resistance to muscles.

For reasons of economy and versatility, it is advantageous to be able to change the weight at the ends of the bars to vary the resistance provided by the exercises. The most common means of doing this is by using disc-shaped plates with central openings that enable them to be slid onto the ends of the bars. These weights are typically retained on the weight bar by placing them against a stop fixed on the inward portion of the bar and securing the weights with a collar that can be placed adjustably on the outer end of the bar and locked into place with set screws or clamps. The drawback associated with collars is that many users of barbells and dumbbells omit the use of collars to save time when changing plates. This practice can be hazardous since tilting the bar from a horizontal position can cause the weight or weights at the lower end of the tilted bar to slide off and seriously injure the user and adjacent persons. Another problem with collars is that they permit the plates to spin, slide, wobble, and rattle which can interfere with control of the barbell during exercises. Collars are also subject to being misplaced or lost.

Other means of securing collars include threads such as disclosed in U.S. Pat. Nos. 4,638,994 and 4,529,197 to Gogarty, serrated flanges that interact with threads on the bar such as disclosed in U.S. Pat. No. 4,738,446 to Miles; and pistons which in fit into recesses in the bar such as disclosed in U.S. Pat. No. 5,605,411 to Wilson. These forms of the prior art provide an alternate means of means of attaching collars to the weight bar but do not substantially negate the drawback associated with conventional collars.

Other prior art addresses the problem of adjustable weight dumbbells and barbells through free weight assemblies that engage the plates by mechanisms that are more sophisticated than collars. Examples are disclosed in U.S. Pat. No. 4,284,463 to Shields (dumbbell assembly having opposite side weights which are connected to a handle by cam driven pins on the weights); U.S. Pat. No. 4,529,198 to Hettick, Jr. (barbell assembly having opposite side weights which are connected to a handle by means of axially movable springs); U.S. Pat. No. 4,822,034 to Shields (barbell and dumbbell assemblies having opposite side weights which are maintained on a shelf and connected to a handle by means of latches on the weights); U.S. Pat. No. 5,839,997 to Roth et al. (dumbbell assembly having opposite side weights which are connected to a handle by means of eccentric cams on a rotating selector rod); U.S. Pat. No. 6,682,464 to Shifferaw (dumbbell/barbell with a bar and a plurality of weights mounted on the bar which are hinged together and can be separated for disengagement from the bar); and U.S. Pat. No. 6,669,6063 to Krull (weight supporting members are rotated into engagement with respective weight plates). A problem with this form of the prior art is that such devices require plates of proprietary design. Many users of exercise equipment already own standard types of commercially-available plates and therefore using this form of the prior art would require them to entail additional expense.

Objects and Advantages

There is a need for exercise devices that can use standard types of plates and that do not require separable collars. The present invention accomplishes this aim and is suitable for using in the form of standard weight bars which have a diameter of about 1-inch and on Olympic style weight bars in which rotatable sleeves that are about 2-inches in diameter are attached at the ends of a solid bar of about 1-⅛-inch diameter.

Some of the objects and advantages of the present invention are:

(a) to provide a means of securing plates that is convenient and quick to use;

(b) to provide a means of securing plates that prevents them from spinning, sliding, wobbling, or rattling;

(c) to provide a means of securing plates that does not rely on collars or other separable securing devices that can be misplaced or lost; and (d) to provide a means of securing plates that allows the use of conventional plates and thereby eliminates the unnecessary expense associated with proprietary pieces of weight-lifting equipment.

SUMMARY OF THE INVENTION

The invention consists of a bar with hollow ends over which plates can be mounted. The plates are secured by means of one or more plungers that are actuated by an internal mechanism that causes the plunger or plungers to rise above the outer circumference of the bar end. The plungers or plungers secure the plates by pressing against the inner face of central opening of the plates and also by wedging against the outer face of the outermost plate as shown. The internal mechanism is operated by turning a handle on the bar.

DESCRIPTION OF DRAWINGS AND PREFERRED EMBODIMENT

Figure 1:
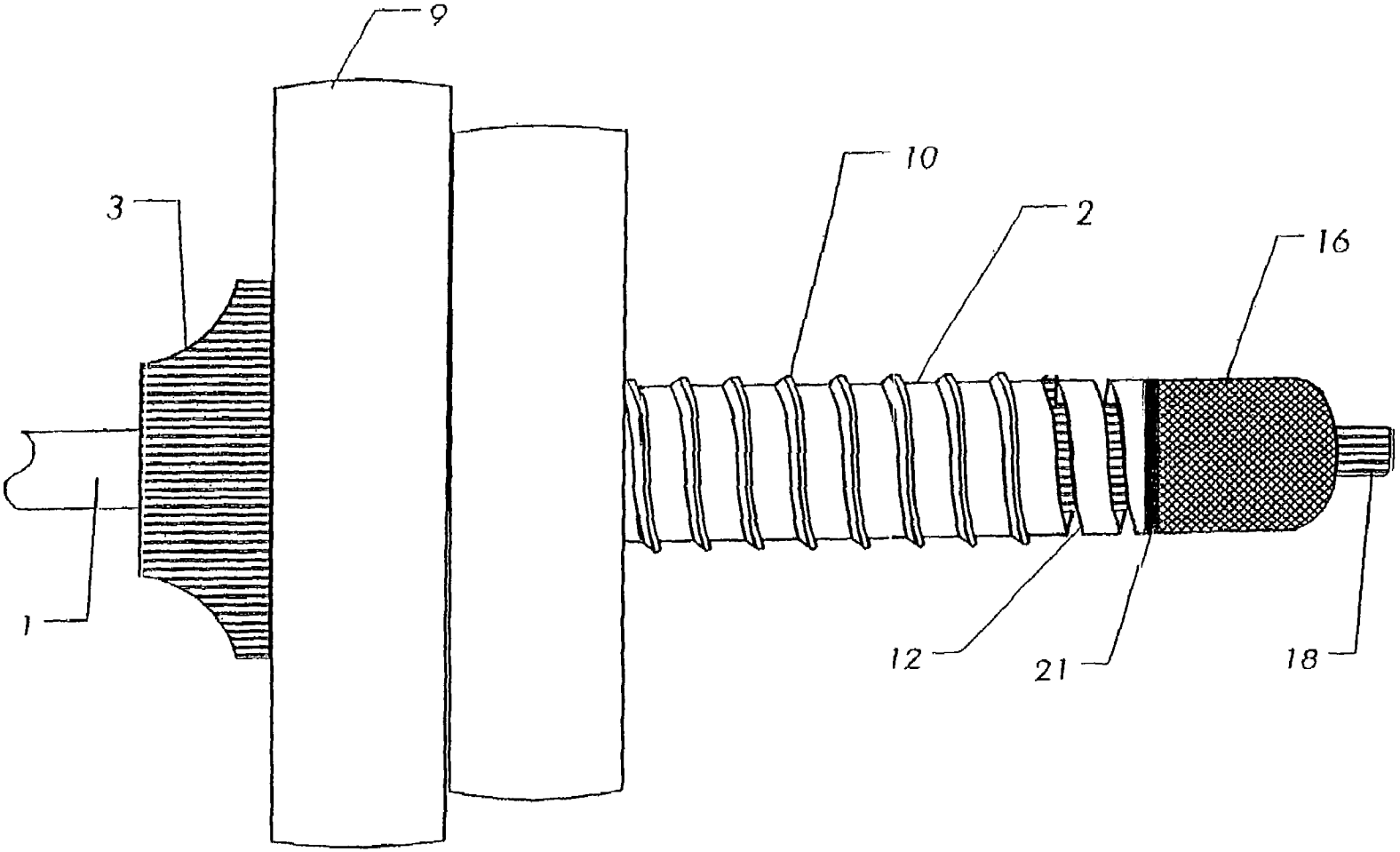
FIG. 1 is a side view of one end of the preferred embodiment of the apparatus of the present invention, the other end being identical in appearance.
Figure 2:
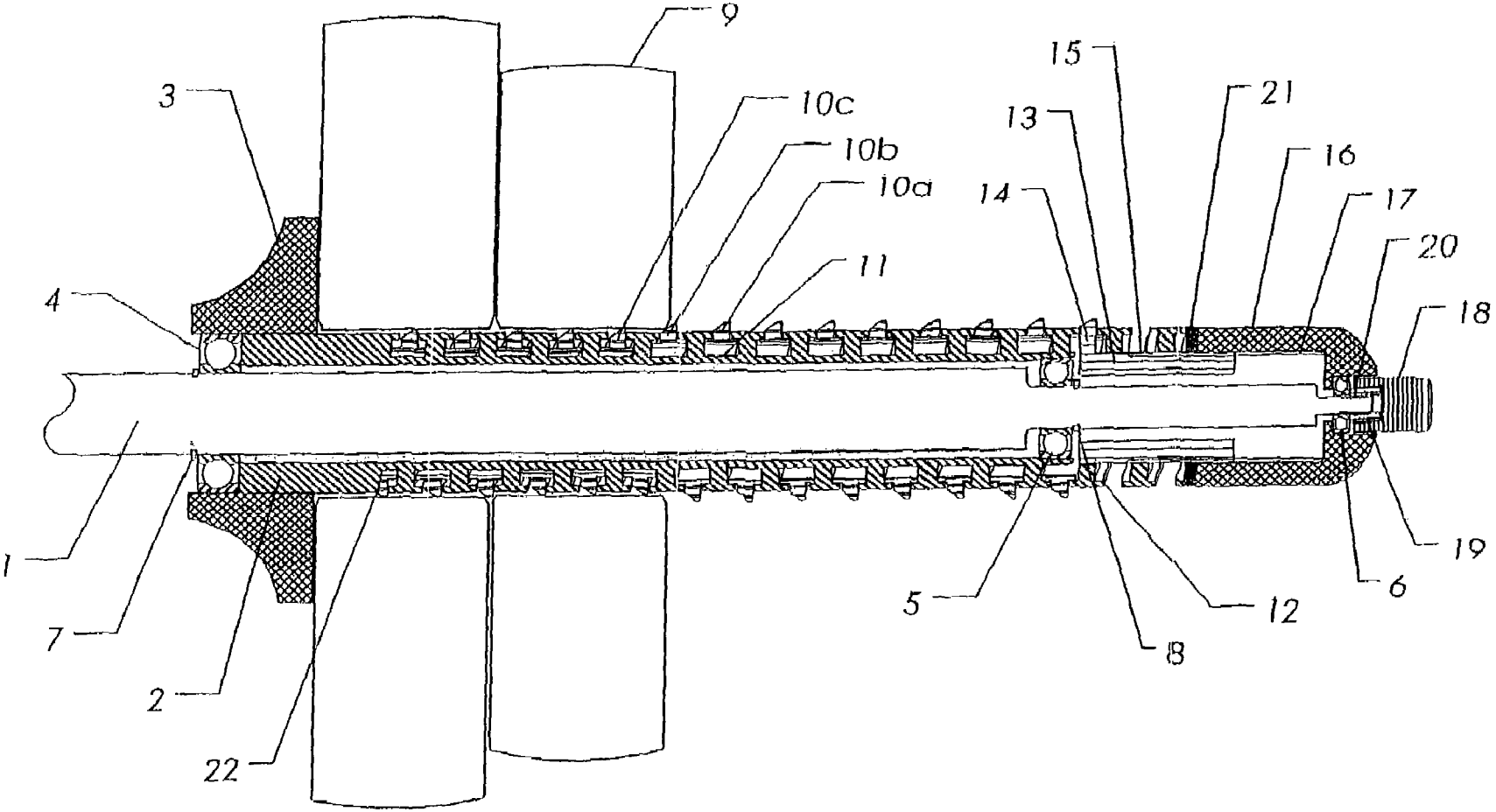
FIG. 2 is a sectional view of the apparatus of the present invention, viewed as if cut using a vertical plane containing the centerline of the apparatus.

As shown in FIG. 1 and FIG. 2 the apparatus includes a cylindrical lifting bar 1 having a rotating sleeve 2 attached using large bearing 4 and medium bearing 5. Rotating sleeve 2 carries a fixed collar 3 and removable weights 9 and provides a helical channel 11 into which a helical expansion member 10 is threaded. A knurled actuating knob 16 is mounted on the cylindrical lifting bar 1 co-axial and adjacent to the rotating sleeve 2. The knurled actuating knob 16 engages with a chasing cylinder 13 using a female spline joint 17 fashioned to the inside of the knurled actuating knob 16 to engage with a male spline joint 15 fashioned onto the outside of chasing cylinder 13. The spline joint allows the chasing cylinder 13 to move axially relative to knurled actuating knob 16 while constrained to follow knurled actuating knob 16 in the radial and circumferential directions. The chasing cylinder 13 includes a chasing tooth 14 which follows helical channel 11 when knurled actuating knob 16 and chasing cylinder 13 are rotated. Helical channel 11 has a solid bottom 12 over most of its length except for approximately two turns which define the path for the chasing tooth wherein the helical channel is open through the wall of rotating sleeve 2. Chasing tooth 14 is securely fastened to the end of helical expansion member 10. Helical expansion member 10 is also securely fastened to stop feature 22 at the far end of helical channel 11. A circular brake washer 21 is located between rotating sleeve 2 and knurled actuating knob 16 to provide static friction to resist turning between the two parts. A small bearing 6 allows knurled actuating knob 16 to mount securely to cylindrical lifting bar 1 yet turn freely in concert with rotating sleeve 2. A knurled pressure adjustment knob 18 having a threaded insert 19 applies axial pressure of varying amount to circular brake washer 21 via knurled actuating knob 16 and bearing 6. Retaining rings 7 and 8 secure the large bearing 4 and medium bearing 5 to cylindrical lifting bar 1 and thereby constrain all other parts from moving axial to cylindrical lifting bar 1.

Figure 3A:
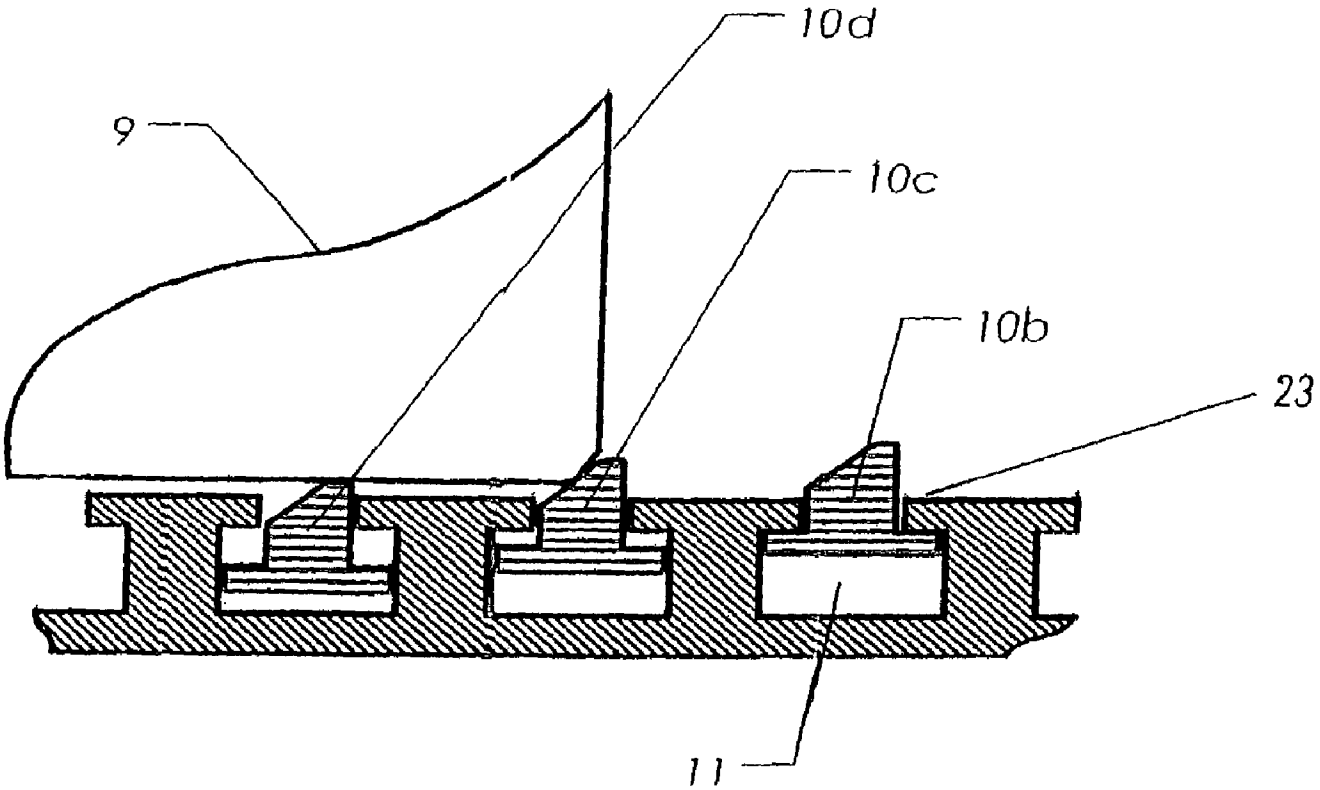
FIG. 3A is a detailed sectional view of the apparatus of the present invention, showing the apparatus in a condition retaining weights.

FIG. 3A shows the use of helical expansion member 10 as it is used to constrain removable weights 9. Fully captured segment 10*d* is typical of the portion of helical expansion member 10 situated underneath and pushing outward in a radial direction to radially constrain removable weights 9. Partially captured segment 10*c* is a very short section of helical expansion member 10 situated at the very edge of removable weights 9, constraining them in both a radial and axial direction. The axial component of pressure is such as to push removable weights 9 toward fixed collar 3, thereby securing removable weights 9 to the barbell apparatus. Non-captured segment 10*b* is typical of the remaining portion of expansion member 10 situated outside the removable weights 9. Non-captured segment 10*b* is expanded in a radial direction until constrained by overhang 23 in helical channel 11.

Figure 3B:
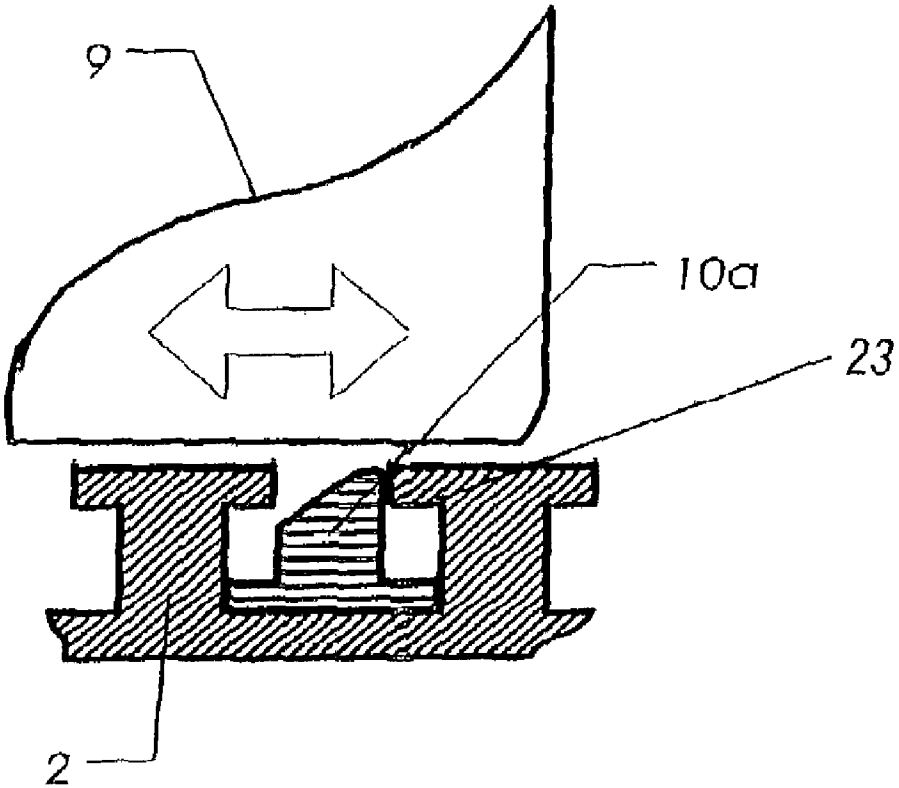
FIG. 3B is a detailed sectional view of the apparatus of the present invention, showing the apparatus in a condition allowing weights to move freely.

FIG. 3B shows the helical expansion member 10 in a fully retracted condition such that removable weights 9 are allowed to move freely and can be installed and removed on rotating sleeve 2. In this condition expansion member 10 is seated on or near the bottom of helical channel 11.

In operation, the user of this apparatus rotates knurled actuating knob 16 in a counterclock-wise direction. This causes chasing cylinder 13 and chasing tooth 14 to retract along helical channel 11. Being attached to chasing tooth 14 at one end and to stop feature 22 at the opposite end, helical expansion member 10 will grow in length and reduce in diameter until it rests in the bottom of helical channel 11. The user can then slide one or more removable weights 9 over the exterior of rotating sleeve 2 until they rest against fixed collar 3.

The user then rotates knurled actuating knob 16 in a clockwise direction which causes chasing cylinder 13 and chasing tooth 14 to extend along helical channel 11, pushing helical expansion member 10 such that it reduces in length and grows in diameter. Sections of expansion member 10 which are disposed under the removable weights 9 are fully captured segments 10*d* and will expand until restrained by the inside diameter of the removable weights 9. The short section of expansion member 10 which is at the edge of removable weights 9 will expand until it is a partially captured segment 10*c*, pushing the removable weights 9 against the fixed collar 3. The remainder of expansion member 10 will be non-captured segments 10*b* which will expand until they are constrained by overhang 23 on helical channel 11. At this point, the user will feel resistance to further rotation of knurled actuating knob 16.

When the user relaxes his grip on knurled actuating knob 16 it remains at the final location due to friction imparted by circular brake washer 21. If the friction is not adequate to hold, the user may tighten knurled pressure adjustment knob 18 to increase the pressure on circular brake washer 21, and thereby increase the braking friction.

To release the removable weights 9 the user simply rotates knurled actuating knob 16 in a counterclockwise direction and removes the removable weights 9.

Figure 4A:
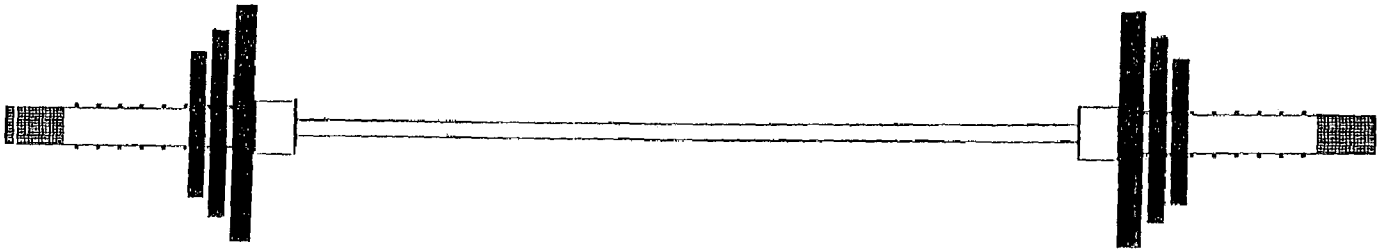
FIG. 4A is a side view of a nonpreferred embodiment of the present invention in which the plungers emerge and retract radially from the bar end and are spaced at intervals along the bar end.
Figure 4B:
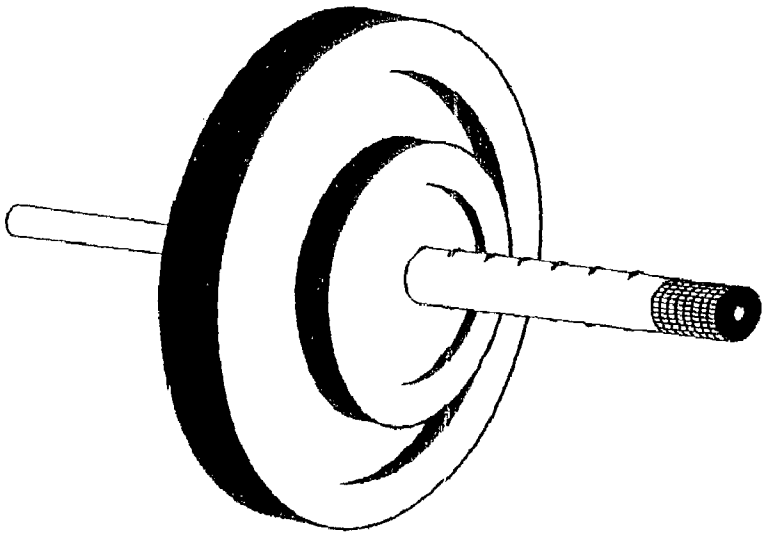
FIG. 4B is a perspective view of one end of the nonpreferred embodiment depicted in FIG. 4A.

There are other ways that the invention can be constructed other than the preferred embodiment. For example, pins, ball bearings, tabs, and other plungers of a predefined shape and size can be inserted into holes situated at predefined intervals along the bar ends and controllably raised and lowered by means such as spring-loaded cams or a deformable cylinder of a material such as rubber that expands radially when axially compressed. An example of a nonpreferred embodiment is illustrated in FIGS. 4A and 4B which shows a way that the concept can be executed using multiple openings in the end of the bar.

There are numerous ways that the plunger or plungers may be controllably actuated to rise and retract from the opening or openings in the end of the weight bar. The basic requirement is that the actuating mechanism be capable of causing the plunger or plungers to move radially outwards when actuated in one operating direction and causing the plunger or plungers to retract when operated in the reverse direction. Two examples are:

a. using a cylinder made of resilient material such as rubber which is assembled to fit inside the bar end in an longitudinal relation with a threaded bolt and compression plates such that the cylinder is axially compressible when the handle at the bar end is rotated and thus causing the cylinder to deform radially outwards whereby it forces the plunger or plungers to rise from the openings in the bar end, and b. using one or more spider rings installed within the bar end, each of which contains a plurality of radial plungers which when activated extend or retract radially through the spider ring and associated openings in the bar end.

I claim:

1. A weightlifting assembly for use with weight plates comprising a central opening, whereby said weightlifting assembly comprises:

a. a weight bar, b. one or more plungers that radially rise and retract from one or more openings in the outer cylindrical face of the bar end causing said plunger or plungers to radially press against the wall of the central opening of weight plates, and c. a means for controllably raising and retracting said plunger or plungers, said means being actuable in one direction to cause the plunger or plungers to rise, and actuable in the reverse fashion, thereby causing the plunger or plungers to retract to their original position.

2. The weightlifting assembly in claim 1, wherein the plunger or plungers are housed in a tubular sleeve that is attached to the weight bar.

3. The weightlifting assembly in claim 1, wherein the plunger or plungers are housed inside a space at the ends of the weight bar.

4. A weightlifting assembly for use with weight plates comprising a central opening, whereby said weightlifting assembly comprises:

a. a weight bar, and b. a plunger in the form of a helical member which is situated in a spiral guide slot in the bar end wherein the helical member can be controllably urged by an actuating means to radially expand outwardly from the guide slot causing said helical member to contact with the inner wall of the central opening of weight plates and to rise above the portion of the outer cylindrical surface of the bar end that is not covered by the central opening of the weight plates, and which helical member can thereafter be controllably retracted inwardly to its original position by said actuating means.

5. The weightlifting assembly in claim 4, wherein the helical member is stopped at one end of the spiral guide slot and in contact with an actuating means at the other end of the helical member wherein the helical member can be rotatably compressed by the actuating means causing the helical member to expand outwardly from the spiral guide slot and thereafter the helical member can be rotatably decompressed by the actuating means causing the helical member to retract inwardly to its original position.

6. The weightlifting assembly in claim 4, wherein:

a. the helical member is stopped at one end of the spiral guide slot and in contact with an actuating means at the other end wherein the helical member can be rotatably compressed by the actuating means causing the helical member to expand outwardly from the spiral guide slot and thereafter the helical member can be rotatably decompressed by the actuating means causing the helical member to retract inwardly to its original position, and b. the helical member is housed in a tubular sleeve that is attached to the weight bar.

7. The weightlifting assembly in claim 4, wherein:

a. the helical member is stopped at one end of the spiral guide slot and in contact with an actuating means at the other end wherein the helical member can be rotatably compressed by the actuating means causing the helical member to expand outwardly from the spiral guide slot and thereafter the helical member can be rotatably decompressed by the actuating means causing the helical member to retract inwardly to its original position, and b. the helical member and actuating mechanism are housed inside a space at the ends of the weight bar.

8. The weightlifting assembly in claim 4, wherein the helical member is stopped at both ends of the spiral guide slot and in contact with an actuating means concentrically situated within the helical member wherein the helical member can be urged radially outwards by the actuating means applying force to the inside of the helical member causing it to expand radially outwards.

9. The weightlifting assembly in claim 4, wherein a. the helical member is stopped at both ends of the spiral guide slot and in contact with an actuating means concentrically situated within the helical member wherein the helical member can be urged radially outwards by the actuating means applying force to the inside of the helical member causing it to expand radially outwards, and b. the helical member and actuating mechanism are housed in a tubular sleeve that is attached to the weight bar.

10. The weightlifting assembly in claim 4, wherein a. the helical member is stopped at both ends of the spiral guide slot and in contact with an actuating means concentrically situated within the helical member wherein the helical member can be urged radially outwards by the actuating means applying force to the inside of the helical member causing it to expand radially outwards, and b. the helical member and actuating mechanism are housed inside a space at the ends of the weight bar.

11. A weightlifting assembly for use with weight plates comprising a central opening, whereby said weightlifting assembly comprises:

a. a weight bar, and b. plungers extending through guide holes in the end of the weight bar, each of said plungers having guide means on the outer cylindrical face of the end of the weight bar, the inner ends of each plunger being operatively connected to an actuating means wherein the plungers are forced outwardly of said outer cylindrical face of the end of the weight bar when the actuating means moves in a first direction and retract inwardly when the actuating means moves in a second direction, thereby causing said plunger or plungers to radially press against the wall of the central opening of weight plates when the actuating means moves in said first direction and to retract from the wall of the central opening of weight plates when the actuating means moves in said second direction.

12. The weightlifting assembly in claim 10 wherein the plungers and actuating mechanism are housed in a tubular sleeves that is attached to the end of the weight bar.

13. The weightlifting assembly in claim 10 wherein the plungers are housed inside a space at the ends of the weight bar.

* * * * *